US006672236B1

(12) United States Patent
Pinsof

(10) Patent No.: US 6,672,236 B1
(45) Date of Patent: Jan. 6, 2004

(54) VESSEL MANEUVERING DEVICE

(76) Inventor: Stewart B. Pinsof, 53 Harbour Green, Key Largo, FL (US) 33037

( * ) Notice: Subject to any disclaimer, the term of this patent is extended or adjusted under 35 U.S.C. 154(b) by 0 days.

(21) Appl. No.: 10/180,848

(22) Filed: Jun. 26, 2002

(51) Int. Cl.[7] ..... B63H 25/46
(52) U.S. Cl. ..... 114/151; 440/6
(58) Field of Search ..... 114/151; 440/6, 440/7, 49, 53, 61, 54, 58

(56) References Cited

U.S. PATENT DOCUMENTS

| | | | | | |
|---|---|---|---|---|---|
| 3,881,443 | A | * | 5/1975 | Hamp | 440/1 |
| 4,208,978 | A | * | 6/1980 | Eller | 114/151 |
| 4,294,186 | A | * | 10/1981 | Wardell | 114/151 |
| 4,487,149 | A | | 12/1984 | Morris | |
| 4,668,195 | A | * | 5/1987 | Smith | 440/6 |
| 4,732,104 | A | | 3/1988 | Roestenberg | |
| 4,807,552 | A | | 2/1989 | Fowler | |
| 5,017,165 | A | * | 5/1991 | Havins | 440/6 |
| 5,140,926 | A | | 8/1992 | Denston | |
| 6,009,822 | A | | 1/2000 | Aron | |
| 6,056,610 | A | | 5/2000 | Fontanille | |
| 6,325,010 | B1 | | 12/2001 | Gruenwald | |
| 6,375,524 | B1 | | 4/2002 | Commandeur | |

* cited by examiner

*Primary Examiner*—Stephen Avila

(57) ABSTRACT

A retractable vessel maneuvering device comprising a thrust producing mechanism (6) and (7), which may be moved between an operating position in the water and a safe storage position out of the water at the stern of a vessel by means of a linear deployment device (2) or a rotary deployment device (3). The deployment device may be affixed directly to the stern or to a platform on the stern of the vessel (11), (33). Said vessel maneuvering device is adaptable to any vessel and energy source with no requirement for through hull openings below the waterline of the vessel.

1 Claim, 3 Drawing Sheets

VESSEL MANEUVERING DEVICE

BACKGROUND OF THE INVENTION

1. Field of Invention

This invention relates to a low cost externally mounted retractable stern thruster to aid vessels in close quarters maneuvering.

2. Background of the Invention

The maneuvering of vessels in close quarters as in crowded harbors and while docking and undocking is difficult using only the vessel's main propulsion system. Large commercial vessels address this problem through the use of tugboats. Smaller vessels may achieve sufficient control with on board systems that produce thrust in a direction perpendicular to the axis of the vessel. Such side thrust systems are well known. When mounted in the bow the system is known as a bow thruster and when mounted in the stern such systems are known as stern thrusters.

The hazards of close quarter vessel maneuvering have been addressed in the prior art. Numerous forms of bow and stern thrusters have been developed to provide side thrust. A basic internal bow thruster consists of a tube installed in the bow of a vessel below the waterline connecting the port and starboard sides of the hull. A drive unit with single or multiple propellers is installed within the tube. Screens to retain debris may also be installed. When activated the propellers provide side thrust to move the bow in the desired direction. A unit of this type is described in U.S. Pat. No. 6,009,822 to Aron. Internal bow thrusters normally are not installed in vessels less than ten meters due to space and cost considerations.

There are many problems associated with an internal bow thruster.

1. High installation cost
2. Potential reduction of structural integrity in the bow sections in normal use and in the event of a collision
3. Clogging of screens can reduce thrust
4. Marine growth can reduce thrust
5. High maintenance cost as the vessel must be dry-docked to service the unit
6. Increased drag resulting from the holes on either side of the bow below the waterline
7. Normally suitable only for vessels longer than ten meters Thrusters have been developed which retract for servicing as in U.S. Pat. No. 6,056,610 to Fontanille. Such devices are practical only for very large vessels and suffer from problems 1, 2, 6 and 7 above.

An external bow thruster is noted in prior art U.S. Pat. No. 4,732,104 to Roestenberg. This device suffers from its exposed storage position on the leading edge of the bow of the boat. Rough sea conditions could damage or break the device loose. A collision with a floating or a fixed object would damage or break loose the device. Once the device is lowered it becomes even more vulnerable to damage. FIG. 1, item 10 is the topmost portion of a vessel's bow and item 12 is the waterline at the bow. The great distance between items 10 and 12 illustrates the high risk associated with mounting an external bow thruster in the location between items 10 and 12.

A partial external bow thruster using water jets is described in U.S. Pat. No. 4,807,552 to Fowler. While the discharge streams in this device are above the waterline, the intake is below the waterline. This intake permanently below the waterline makes the unit vulnerable to leakage debris ingestion and marine growth performance degradation.

Stern thrusters are similar to bow thrusters in that a tunnel is created through the hull below the waterline at the stern of the vessel. Internal stern thrusters of this type suffer from the same problems enumerated above for internal bow thrusters.

A partial solution to an internal stern thruster is presented in U.S. Pat. No. 4,487,149 to Morris. This device utilizes a drive within a tunnel permanently mounted beneath the waterline of the vessel from the swim platform. FIG. 1, item 11 illustrates a typical swim platform. This system addresses the potential hazard of structural damage or leakage from an internal tube through the hull. All other problems associated with the internal bow thrusters apply to this device.

OBJECTS AND ADVANTAGES OF THE INVENTION

Accordingly several objects and advantages of my invention are:

(a) to provide a vessel maneuvering device whose attachments and power supply are all above the waterline.

(b) to provide a vessel maneuvering device that may be retracted when not in use so that said device is out of water precluding marine growth and corrosion performance degradation:

(c) to provide a vessel maneuvering device that is stored in a location when not in use where the device is not subject to damage from debris and high seas.

(d) to provide a vessel maneuvering device installation that is inexpensive compared to currently available devices (e) to provide a vessel maneuvering device which does not detract from vessel performance when the device is not in use and the vessel is under way.

(f) to provide a vessel maneuvering device which may easily be removed for service or storage.

(g) to provide a vessel maneuvering device that may be equipped with a wide variety of hand or foot control systems.

(h) To provide a vessel maneuvering device that is economic, effective and practical for vessels below 10 meters as well as larger vessels.

(i) To provide a vessel maneuvering device that may be easily mounted and adapted to any vessel.

(j) To provide a vessel maneuvering device that may positioned for use and retracted for storage manually or by commonly available electrical, mechanical, hydraulic or pneumatic devices;

(k) To provide a vessel maneuvering device that may be operated at the device or anywhere on the vessel with commonly available controls.

(l) To provide a vessel maneuvering device that may be powered by electricity, hydraulics or pneumatics.

SUMMARY

In accordance with the present invention a vessel maneuvering device which utilizes a thrust producing mechanism affixed to a deployment device which is attached to the stern of a vessel with no requirement for through hull openings below the waterline. Said deployment device allows said thrust mechanism to be moved between an operating position in the water and a safe storage position out of the water.

DRAWINGS

FIG. 5 is a view of a single engine vessel, which illustrates a possible mounting of more than one thrust mechanism.

DRAWINGS—LIST OF REFERENCE NUMERALS

Figure 1:
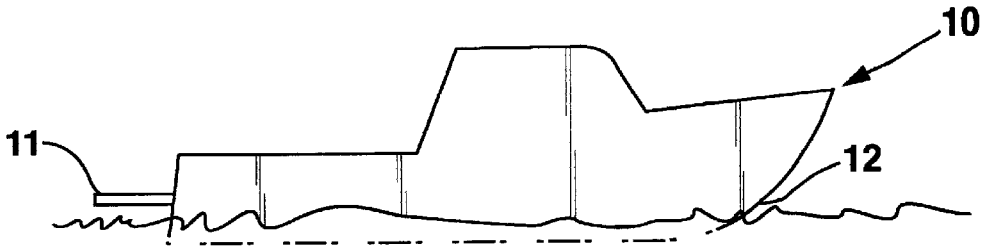
FIG. 1 is a cross section of a vessel referencing the waterline and the position of the bow and swim platform attached to the stern.

10 uppermost point of vessel bow
11 swim platform or support structure mounted low on stern of vessel
12 waterline of vessel
13 flange with mounting holes of linear deployment device
14 hinge for locking device which secures the support arm
15 support arm of the thrust mechanism passing through the locking mechanism
17 handle actuating locking mechanism of the linear deployment device
18 power unit for a thrust mechanism
19 propeller for thrust mechanism
21 linear deployment device
22 stern of vessel
23 hinge for under support structure rotational deployment device
24 support arm tor rotational deployment device
25 retraction arm or cable to raise and lower thrust mechanism in rotational plane
26 attachment point on the power source
27 hollow support member of thrust mechanism
28 energy source for thrust mechanism
29 power source with two propellers
30 external mounting clamp for power unit
31 support member for power unit
33 specially constructed support structure

DETAILED DESCRIPTION

The components of the external retractable stern thruster include a thrust producing device, a deployment device and an optional support structure. The deployment device is capable of moving said thrust producing device between an above water storage position to a below the water operating position. All components are outside the hull eliminating the requirement for through hull openings below the waterline.

SUPPORT STRUCTURE

The optional support structure provides a secure attachment to the stern of the vessel allowing the vessel maneuvering device to be mounted externally. Pleasure vessels frequently have swim platforms 11 which may provide an existing suitable support structure.

When no swim platform is available as on sailboats a platform 33 may be affixed to the stern of the vessel to accomplish the requisite purpose of a support structure. Such platform serving the single purpose of support structure need meet only the criteria of suitable strength and size to accommodate the thrust and mounting mechanisms.

While a platform type support structure is desirable for manual operations and for servicing the mechanisms the support structure need not include a platform such as 11 and 33. A deployment device may be directly attached to the stern of the vessel with no diminishment of the features of the invention.

Thrust Mechanism

Figure 6:
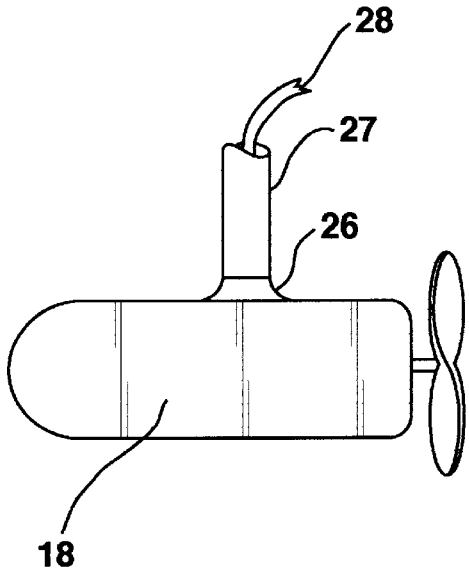
FIG. 6 illustrates a single propeller power source whose case provides a mounting point for a tube, which serves as a mount for the engine and a conduit for the energy source.
Figure 7:
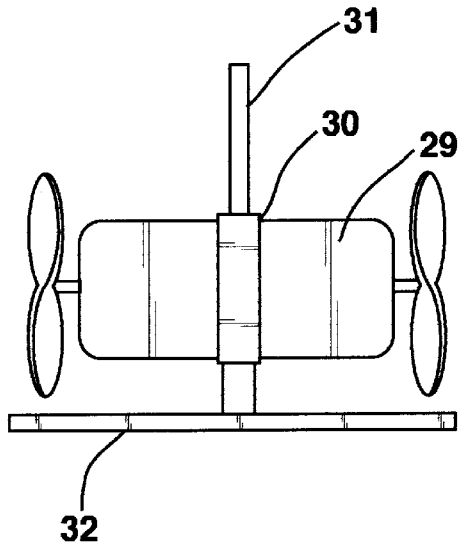
FIG. 7 illustrates a twin propeller power source with a clamp type mounting system leading to a support column. Below the motor a sealing plate is shown which can seal the access hole through the support structure when the device is not in use and is in the stored position.

Thrust may be generated by a propeller 19 mounted on a power source 18. The power source may utilize a single propeller as illustrated in FIG. 6 or two propellers as illustrated in FIG. 7. A single propeller thrust producing mechanism would have a lesser thrust output when operated in the reverse direction. Such diminished reverse thrust does not diminish the utility of the invention. Two propellers would allow for equal thrust in both directions with the use of a minimal size propeller. When a single propeller is used it may be made of a larger than normal diameter which would minimize the blocking effect of the power source when the propeller is operating in reverse. The effect of said dual propellers or an oversize propeller would be to equalize the thrust mechanism's thrust in forward and reverse. A propeller with any number of blades may be used. The power source 18 may be an electric hydraulic or pneumatic device.

Thrust may also be produced with a pump produced water jet in place of the power source and propeller.

The energy supply 28 for the thrust mechanism may be conveyed from the vessel to the power source 18 through flexible lines. Such flexible lines may be routed to the power source through fittings above the waterline of the vessel thereby reducing cost, maintenance and risk of leakage.

Figure 4:
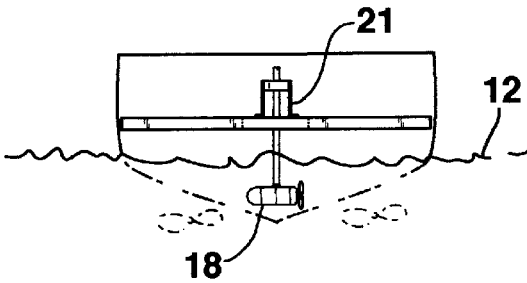
Figure 5:
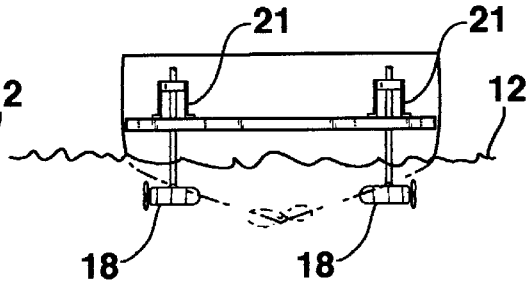
FIG. 5 is a view of the stern of a twin engine vessel which illustrates a possible mounting of a single thrust mechanism through a support structure on the centerline of the vessel.
Figure 8:
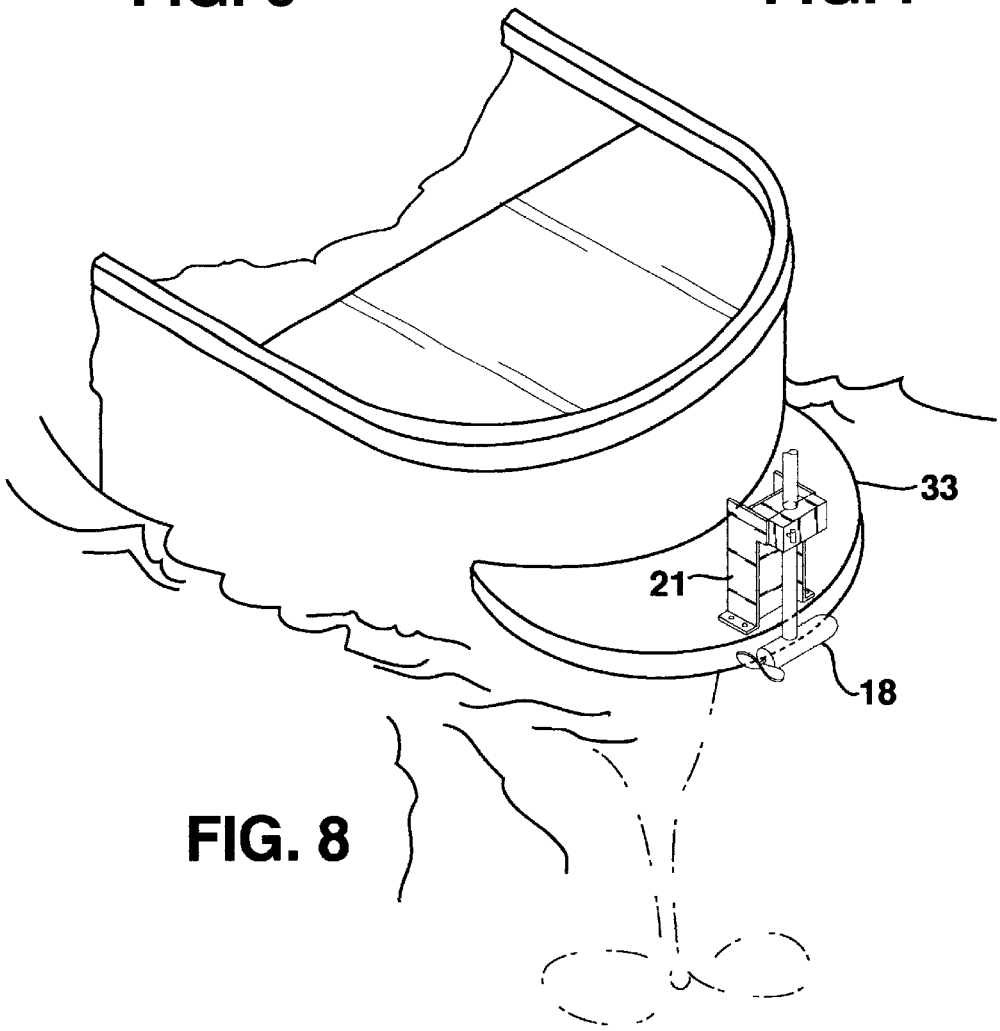
FIG. 8 illustrates a specially constructed support structure upon which the mounting mechanism may be mounted.

The thrust mechanism 18 may consist of single, FIGS. 4 and 8 or multiple power sources, FIG. 5. Said thrust mechanism may be mounted anywhere on the stern of the boat and need not be symmetrical for effective operation.

Selection of optimum thrust mechanism positioning on the support structure would balance several vessel specific factors such as:

(a) interference from primary propulsion prop wash
(b) ability of the selected deployment device to effectively immerse and withdraw the thrust mechanism
(c) the location of a storage position offering maximum security to the thrust unit.

The power source for vessels under 10 meters may be low voltage drive motors. Such drive motors may be powered from the vessels battery system or by a separate battery system. The current draw from such motors while high is only for brief periods normally measured in seconds and therefore results in minimal effect on the vessel's battery system especially since the vessel's main engines and charging systems are functioning during use of the stern thruster.

Large vessels may use high voltage motors run from onboard generators, or they may use hydraulic or pneumatic motors. Irrespective of the energy source the energy is transferred to the thrust unit via flexible lines negating any requirement for openings in the vessel's hull below the water line. One possible method of energy transmission is illustrated in FIG. 6. In the example of FIG. 6 an electric motor 18 has a female pipe thread 26 affixed to said motor's housing. A pipe 27 threads into 26 to provide a connection between the thrust mechanism and the deployment device. Electric leads are led to said motor through said pipe.

Controls for the thrust mechanism may be of a type appropriate to the energy source. Such controls should allow for rapid and easy transition from forward to reverse. In use the vessel maneuvering device of this invention works well with the power source having a single speed. Directional control is achieved by brief inputs of power. Alternatively the power source could be equipped with variable speed controls. The selected controls may be mounted in a convenient and intuitive location for the operator. Foot pedal operation may be used to allow an operator to have both hands free for other control functions. If more than one person is available during close quarter maneuvers the controls for this invention may be placed at the stern near or directly on the deployment device.

Deployment Device

The deployment device affixes the thrust mechanism to the support structure or directly to the stern of the vessel. Said deployment device provides support for the thrust mechanism in both the storage and use positions. Said deployment device provides positive positioning of the thrust mechanism at the desired angle to the centerline of the vessel. Normally said angle would be ninety degrees. Special considerations might warrant other mounting angles which the deployment device could provide when needed. The deployment device provides positive positioning of the thrust mechanism in both its lowered in use position and its raised storage position the deployment device further provides a means of lowering the thrust mechanism into the water and retracting it to a safe storage position out of the water.

Figure 2:
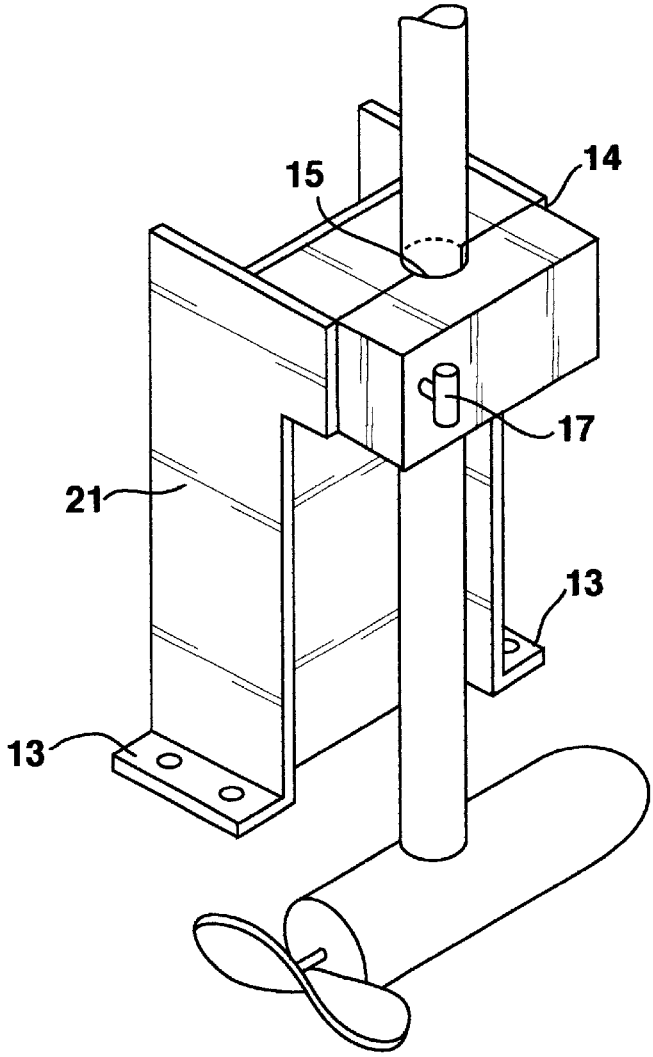
FIG. 2 is a perspective plan of a linear deployment device which provides for linear movement of the thrust mechanism and further provides for locking the thrust mechanism in the desired operational or stored position.

FIG. 2 illustrates a linear retraction deployment device utilizing a thrust producing mechanism of the type shown in FIG. 6. The framework 21 is fastened to a support structure with bolts through holes in flange 13. In this example the support member 27 of the thrust mechanism serves as a conduit for the energy source 18 and passes through a clamp device consisting of a hinge 14 and a lock mechanism 17. Said clamping device secures the thrust mechanism in either the stored or operating position. An opening in the platform 11 below the thrust mechanism 18 allows for said thrust mechanism to be lowered and raised through the platform. A sealing member 32 may be incorporated to seal said opening when the thrust mechanism is in the stored position. The linear retraction deployment device illustrated in FIG. 2 is positioned facing aft. Linear retraction deployment devices may be positioned facing any direction that is most suitable for the individual application.

Figure 3:
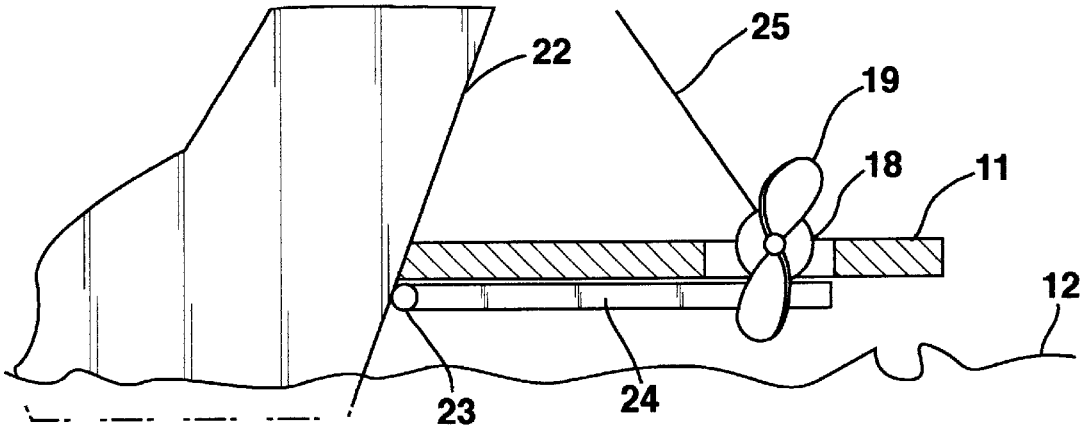
FIG. 3 is a cross section illustrating a swim platform extending from the stern of a vessel, said platform having an opening to allow for the thrust mechanism to be retracted out of the water when not in use. The deployment device illustrated is a rotary configuration, which is mounted to an arm hinged below the swim platform to allow for rotational deployment and retraction.

A pivoting deployment device may be used. Such a device may be mounted above or below a support structure 11, on the stern of the boat or directly to the stern. FIG. 3 illustrates a form of under platform deployment device. A support member 24 upon which is mounted the thrust unit 18 is hinged at 23. A retracting arm or cable 25 is utilized to position the thrust unit. Said support member and hinge or comparable mechanisms may be mounted above or below the support structure 11 and at any suitable point on the support structure. The rotation may be in the for and aft plane as illustrated or at any suitable angle to the fore and aft plane.

The two examples of deployment devices are for illustration only. Any variation of linear and rotational retraction mechanism may be incorporated into a deployment device to achieve the desired combination of support alignment and positioning of the thrust mechanism.

Operation of the deployment device including its positioning features may be manual or automated. For small vessels under 15 meters manual retraction may be used. For larger vessels or smaller vessels desiring automatic operation, retraction and positioning may be accomplished with well known and readily available mechanical, electrical, hydraulic or pneumatic devices.

The elements of this invention illustrated in FIGS. 9 through 8 are examples of possible, but not all forms each of these elements might take. The utility of this invention is enhanced by the ability of the features of the invention to be retained with an vessel specific variations of each of the elements of the invention.

OPERATION OF THE INVENTION

When preparing to maneuver in close quarters such as in approaching or departing a dock the thrust mechanism is deployed by lowering and locking said mechanism in its operating position. This deployment may be done while the vessel is moving toward the maneuvering area at slow speed. Activation of the control system will cause rotation of the propeller on the thrust mechanism creating thrust perpendicular to the axis of the vessel which will move the stern of the vessel in the desired lateral direction. The lateral motion of the stern results in a similar but opposite rotation of the bow. The result is the boat may be steered at slow speed in forward or reverse through the use of the vessel maneuvering device without the use of the rudder which is only minimally effective at slow speeds.

Activation of the vessel maneuvering device allows for rotation of the vessel in either direction with no forward or reverse motion when desired. The ability to move the stern perpendicular to the axis of the vessel allows for controlled backing maneuvers. Backing into a slip may be accomplished with solid control at very slow speed thereby minimizing the risks of damage to the vessel adjacent vessels or dock structures.

The ability to swing the stern with no forward or reverse movement is also useful when docking at long docks. The situation is comparable to parallel parking a car in a very small space. The operator may control the speed of vessel rotation by brief activation cycles of the thrust mechanism. The operator may reduce the speed of rotation by the application of reverse thrust with the thrust mechanism.

The ability to rotate the boat with no or minimal forward motion is also helpful when maneuvering a vessel in the forward direction. The approach can be made with full control at a slow safe speed.

The vessel maneuvering device is also a valuable maneuvering aid with twin screw vessels. When the placing of one engine in forward and the other in reverse provides insufficient control the use of throttle is frequently required. This can cause a hazard of collision and damage to transmissions. The added rotational motion imparted by the vessel maneuvering device can reduce or eliminate the requirement for main engine throttle. When main engine throttle is essential, the use of a loot control for the vessel maneuvering device leaves both hands free for the operator minimizing the hazard of the maneuver.

Once the vessel has docked or has cleared the congested area of a harbor, while still moving at low speed, the vessel maneuvering device is retracted. Once in its stored position the device is safe from head seas, collision and marine growth.

CONCLUSION RAMIFICATIONS AND SCOPE OF INVENTION

This invention provides a versatile vessel maneuvering device. The exact configuration of the elements of this invention are easily adjusted to specific vessel requirements without loss of effectiveness. The elements of this device allow for economic installation on any size vessel including vessels under ten meters in length. The unique ability to store and service the thrust mechanism out of the water in a safe location at the stern of the vessel results in acquisition. installation and service costs well below other vessel maneuvering devices.

While my descriptions above contain many specificities, these should not be construed as limitations on the scope of the invention, but rather as an exemplification of certain preferred embodiments. Other possible variations would include, but are not limited to:

1. The elimination of the support mechanism through a direct attachment of the deployment device to the stern of the vessel.
2. An open support mechanism that is not a platform.
3. A support mechanism that attaches below the waterline.
4. A thrust mechanism that does not use a propeller such as a water pump or paddle wheel.
5. An energy source that emerges below the waterline
6. A linear deployment device that uses slides similar to drawer slides
7. A linear deployment device that uses a hydraulic or pneumatic cylinder as a component of the mounting mechanism.
8. A linear deployment device that uses gears, rack and pinions, and other comparable mechanisms.
9. A deployment device that rotates the thrust mechanism about its support axis to allow for variable positioning of the thrust mechanism in its in service and stored position.
10. A deployment device positioned in any position and operating in any plane in addition to those shown in the illustrations.
11. A deployment device mounted above, below or within the support structure.
12. A rotational deployment device which may require no separate locking mechanism as said device in combination with the weight of the thrust producing mechanism serve in combination to provide the requisite positive positioning of the thrust producing mechanism.

Accordingly, the scope of the invention should be determined not by the embodiments illustrated, but by the appended claims and their legal equivalents.

I claim:

1. A pair of stern thrusters for a vessel, comprising:

a. the vessel having a bow and a stern, and the vessel further having a horizontal platform mounted aft of the stern, b. the stern thrusters being mounted on opposite sides of a longitudinal axis of the vessel to provide thrust perpendicular to the longitudinal axis of the vessel for vessel maneuvering; each stern thruster having the following features:

c. a waterproof power unit having a longitudinal axis;

d. at least one propeller mounted to the power unit along the longitudinal axis of the power unit;

e. a linear deployment device to raise and lower the waterproof power unit and the propeller, a hollow support pipe to connect the waterproof power unit and the linear deployment device;

f. the power unit using direct current which is delivered to the waterproof power unit via a flexible line which extends through the hollow support pipe;

g. the linear deployment device mounted directly above and to the horizontal platform and above the vessel waterline allowing the waterproof power unit and propeller to be raised above the waterline when not in use and lowered into the water when in use.

* * * * *